US007926586B2

(12) United States Patent
Zhong et al.

(10) Patent No.: US 7,926,586 B2
(45) Date of Patent: Apr. 19, 2011

(54) HAND-HELD POWER TOOL WITH A PNEUMATIC PERCUSSION MECHANISM

(75) Inventors: James Zhong, Shanghai (CN); Kevin Guo, Shanghai (CN); Rory Britz, Shanghai (CN)

(73) Assignee: Hilti Aktiengesellschaft, Schaan (LI)

( * ) Notice: Subject to any disclaimer, the term of this patent is extended or adjusted under 35 U.S.C. 154(b) by 252 days.

(21) Appl. No.: 12/313,485

(22) Filed: Nov. 19, 2008

(65) Prior Publication Data

US 2009/0133893 A1 May 28, 2009

(30) Foreign Application Priority Data

Nov. 27, 2007 (CN) ..... 2007 1 0196416

(51) Int. Cl.
*B25D 17/06* (2006.01)

(52) U.S. Cl. ..... 173/201; 173/109; 173/171

(58) Field of Classification Search ..... 173/201, 173/109, 104, 91, 48, 171
See application file for complete search history.

(56) References Cited

U.S. PATENT DOCUMENTS

| | | | | |
|---|---|---|---|---|
| 2,533,487 | A | 12/1950 | Mauer et al. | |
| 4,537,264 | A * | 8/1985 | Schmid et al. | 173/48 |
| 5,159,814 | A * | 11/1992 | Jakobsson | 60/542 |
| 5,373,905 | A * | 12/1994 | Bleicher et al. | 173/109 |
| 5,787,996 | A * | 8/1998 | Funfer | 173/104 |
| 6,732,815 | B2 * | 5/2004 | Hanke et al. | 173/201 |
| 7,216,749 | B2 * | 5/2007 | Droste | 192/56.61 |

FOREIGN PATENT DOCUMENTS

| | | |
|---|---|---|
| DE | 0494775 | 3/1930 |
| DE | 1809016 | 6/1970 |
| GB | 0011793 | 5/1898 |
| GB | 0659331 | 10/1951 |

OTHER PUBLICATIONS

U.S. Patent Application Publication, US 2006/0243468 A1, Nov. 2, 2006.
European Search Report.

* cited by examiner

*Primary Examiner* — Scott A. Smith
(74) *Attorney, Agent, or Firm* — Abelman, Frayne & Schwab

(57) ABSTRACT

A hand-held power tool includes a pneumatic percussion mechanism having a percussion piston reciprocating along a percussion axis and having a bore extending at an angle to the percussion axis, and an air spring for displacing the percussion piston.

10 Claims, 1 Drawing Sheet

HAND-HELD POWER TOOL WITH A PNEUMATIC PERCUSSION MECHANISM

BACKGROUND OF THE INVENTION

1. Field of the Invention

The present invention relates to a hand-held power tool including a pneumatic percussion mechanism having a percussion piston reciprocating along a percussion axis and an air spring for displacing the percussion piston, and, advantageously, to a hammer drill or a chisel hammer.

2. Description of the Prior Art

Generally, an electromechanically driven percussion mechanism of a hand-held power tool has a percussion piston that reciprocates in a guide tube under action of an air spring. The percussion piston applies blows to a working tool, which is received in a chuck of the power tool, either through an anvil or directly to an end surface of the working tool. To provide for a tilt-free axial displacement of the percussion piston, the axial length of the percussion piston is mostly greater than the guide diameter of the guide tube.

Usually, the percussion piston and, optionally, the anvil are formed of steel, which provides for a sufficiently high strength and toughness for generation of impact pulses. However, the percussion piston can, e.g., be formed of a plastic material, as disclosed in U.S. Pat. No. 3,402,776.

U.S. Pat. No. 2,283,292 discloses an electrical hand-held power tool a pneumatic percussion mechanism of which has a reciprocating driving cylinder in which a steel percussion piston reciprocates under the action of an air spring. The percussion piston is formed of a plurality of solid cylindrical bodies assembled together and forming a solid body of the percussion piston. For lightweight electrical hand-held power tools, such a percussion piston is too heavy.

Accordingly, an object of the present invention is to provide a high-power lightweight hand-held power tool.

Another object of the present invention is to provide a suitable percussion piston for a high-power lightweight power tool and which can be produced technologically simply.

SUMMARY OF THE INVENTION

These and other objects of the present invention, which will become apparent hereinafter, are achieved by providing a hand-held power tool of a type described above, a percussion piston having a bore extending at an angle to the percussion axis.

With a bore, the bore containing body of the percussion piston is substantially lighter than a (initial) solid body at a given length and guide diameter. The bore is formed in an usually machined percussion piston having a solid body by a technologically simple manufacturing process, in particular, by drilling. This permits to technologically simple vary the mass of the percussion piston (in different percussion mechanisms). A bore which has a bore diameter specific for a particular percussion mechanism, specific bore diameter is formed in homogeneous tubular percussion piston having a solid body.

Advantageously, the inventive percussion piston is formed of steel, whereby a high load-carrying capacity is achieved.

Advantageously, the percussion piston (which is formed rotationally-symmetrical up to the bore) has an axial length in a range from one to one and a half of a guide diameter of the percussion piston. This insures a good displacement of the percussion piston in a guide tube or in a driving cylinder.

Advantageously, an end of the percussion piston has a radial reduction with a spherical impact surface. This provides for impact pulse transmission to the anvil or the working tool with little reverberations.

Advantageously, the reduction forms a radial bead adjacent to the impact surface. Thereby, in case of an idle impact of the percussion piston, it can be temporarily stopped in an annular elastic interceptor device.

Advantageously, an end surface of the percussion piston opposite the impact surface is formed flat. This insures that pressure forces are applied axially to the percussion piston by the air spring.

Advantageously, between the opposite flat end surface and the bore, a circumferential radial groove is formed in the percussion piston. This permits to insert, in the radial groove, an O-ring for an air-tight displacement.

Advantageously, the bore is arranged centrally with respect to the percussion axis. This permits to maximize a possible bore depth.

Advantageously, the bore has a diameter that lies in a range from one-half to three fourth of a guide diameter of the percussion piston. This provides for a substantial saving of material and mass reduction at a sufficient strength of the percussion piston.

Advantageously, the bore extends to the percussion axis at an angle of 90°. Thereby, the bore is formed as a cross-bore.

Advantageously, the bore is formed as a through-bore. This permits to maximize the bore volume.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiment, when read with reference to the accompanying drawings.

DETAILED DESCRIPTION OF THE PREFERRED EMBODIMENT

Figure 1:
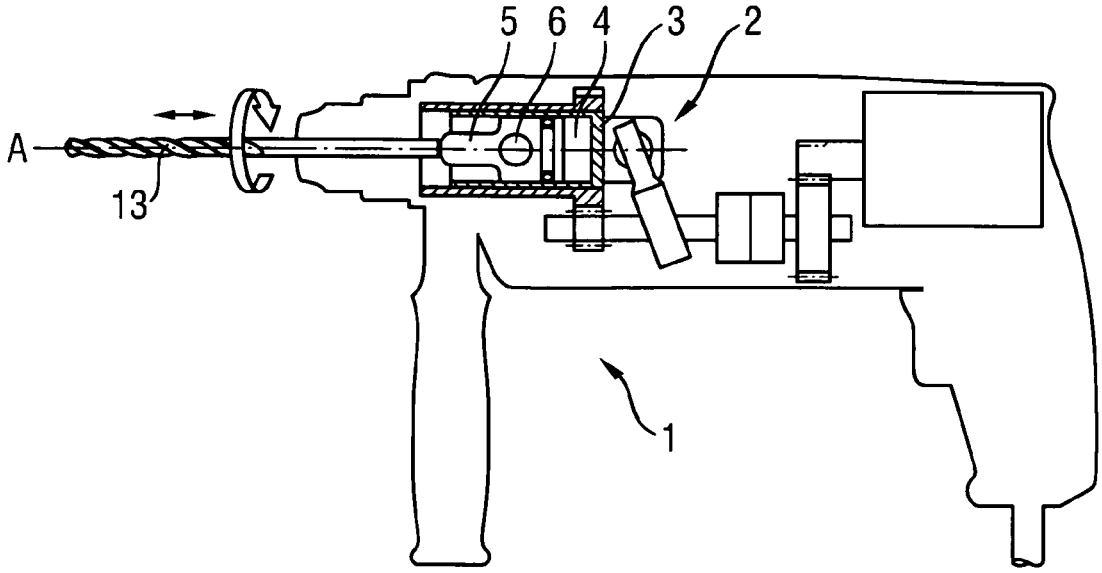
FIG. 1 a partially cross-sectional schematic view of a hand-held power tool according to the present invention.

A rotary-percussion hand-held power tool 1 according to the present invention for driving a working tool 13, which is formed as a combination hammer and is shown in FIG. 1, includes a pneumatic percussion mechanism 2 having a driving cylinder 3 within which a percussion piston 5 reciprocates along a percussion axis A under action of an air spring 4. The percussion piston 5 is pierced by a bore 6 that extends at a right angle to the percussion axis and crosses the same, i.e., is formed as a cross-bore.

Figure 2:
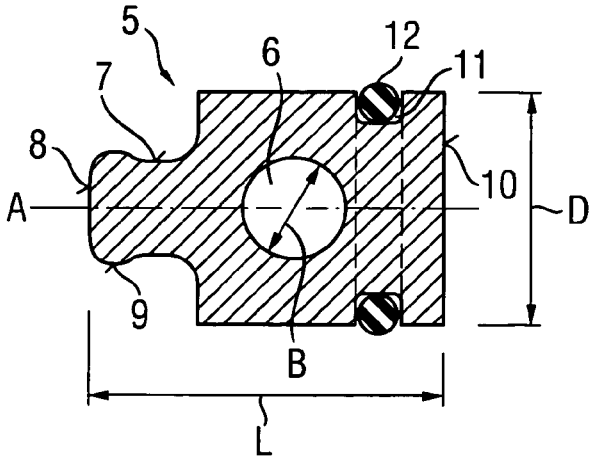
FIG. 2 a longitudinal cross-sectional view of the percussion piston of the power tool shown in FIG. 1.

As shown in FIG. 2, the percussion piston 5 (which is formed rotationally-symmetrical up to the bore 6) and which is formed of steel, has an axial length L that amounts to about 1.5 times of its diameter D. One of the axial end side has a radial reduction 7 with a spherical impact surface 8 and a radial bead 9 formed adjacent to the impact surface 8. The end surface 10 of the percussion piston 5 opposite the impact surface 8 is formed flat. Between the end surface 10 and the bore 6, which is transverse to the percussion axis A, is centrally arranged and has a diameter B that amounts to a half of the guide diameter D (the diameter of the guide region), there is provided, on the percussion piston 5, a circumferential radial groove 11 in which a rubber O-ring 12 is arranged.

Though the present invention was shown and described with references to the preferred embodiment, such is merely illustrative of the present invention and is not to be construed as a limitation thereof and various modifications of the present invention will be apparent to those skilled in the art. It is therefore not intended that the present invention be limited to the disclosed embodiment or details thereof, and the present invention includes all variations and/or alternative embodiments within the spirit and scope of the present invention as defined by the appended claims.

What is claimed is:

1. A hand-held power tool, comprising a pneumatic percussion mechanism (2) including a percussion piston (5) reciprocating along a percussion axis (A) and having a bore (6) extending at an angle to the percussion axis (A), and an air spring (4) for displacing the percussion piston, wherein the bore (6) has a diameter (b) that lies in a range from one-half to three-fourth of a guide diameter (D) of the percussion piston (5).

2. A hand-held power tool according to claim 1, wherein the percussion piston (5) is formed of steel.

3. A hand-held power tool according to claim 1, wherein the percussion piston (5) has an axial length (L) that lies in a range from one to one and a half of a guide diameter (D) thereof.

4. A hand-held power tool according to claim 1, wherein an axial end side of the percussion piston has a radial reduction (7) with a spherical impact surface (8).

5. A hand-held power tool according to claim 4, wherein the reduction (7) forms a radial bead (9) adjacent to the impact surface (8).

6. A hand-held power tool according to claim 4, wherein an end surface (10) of the percussion piston (5) opposite the impact surface (8) is formed flat.

7. A hand-held power tool according to claim 6, wherein between the opposite end surface (10) and the bore (6), a circumferential radial groove (11) is provided.

8. A hand-held power tool according to claim 1, wherein the bore (6) is arranged centrally with respect to the percussion axis (A).

9. A hand-held power tool according to claim 1, wherein the bore (6) extends to the percussion axis (A) air an angle of 90°.

10. A hand-held power tool according to claim 1, wherein the bore (6) is formed as a through-bore.

* * * * *